US009551189B2

(12) United States Patent
Brady

(10) Patent No.: US 9,551,189 B2
(45) Date of Patent: Jan. 24, 2017

(54) POLYCRYSTALLINE DIAMOND PERCUSSION DRILL BITS USING LOW THRUST AND TORQUE FOR APPLICATION WITH SMALL DIAMETER DRILL BITS

(71) Applicant: William J. Brady, St. Louis, MO (US)

(72) Inventor: William J. Brady, St. Louis, MO (US)

(73) Assignee: WBM-LLC, St. Louis, MO (US)

( * ) Notice: Subject to any disclaimer, the term of this patent is extended or adjusted under 35 U.S.C. 154(b) by 488 days.

(21) Appl. No.: 13/987,893

(22) Filed: Sep. 16, 2013

(65) Prior Publication Data

US 2014/0014412 A1 Jan. 16, 2014

Related U.S. Application Data

(60) Division of application No. 12/550,093, filed on Aug. 28, 2009, now abandoned, which is a continuation-in-part of application No. 12/273,700, filed on Nov. 19, 2008, now abandoned.

(60) Provisional application No. 61/744,090, filed on Sep. 18, 2012, provisional application No. 61/022,614, filed on Jan. 22, 2008.

(51) Int. Cl.

| | |
|---|---|
| ***E21B 10/36*** | (2006.01) |
| ***E21B 10/46*** | (2006.01) |
| ***E21B 10/567*** | (2006.01) |
| ***E21B 17/10*** | (2006.01) |
| ***E21B 1/00*** | (2006.01) |

(52) U.S. Cl.

CPC ..... *E21B 10/36* (2013.01); *E21B 1/00* (2013.01); *E21B 10/46* (2013.01); *E21B 10/5673* (2013.01); *E21B 17/1092* (2013.01)

(58) Field of Classification Search

CPC ..... E21B 1/00; E21B 10/36

See application file for complete search history.

(56) References Cited

U.S. PATENT DOCUMENTS

| | | | | |
|---|---|---|---|---|
| 2,725,216 | A | 11/1955 | Brown | |
| 3,388,756 | A | 6/1968 | Varel et al. | |
| 3,788,409 | A | 1/1974 | Curington | |
| 3,955,635 | A * | 5/1976 | Skidmore | E21B 10/56 175/400 |
| D340,248 | S | 10/1993 | Brady | |
| D351,174 | S | 10/1994 | Brady | |
| 5,794,728 | A * | 8/1998 | Palmberg | E21B 10/56 175/418 |
| 5,875,858 | A | 3/1999 | Brady | |
| 5,944,129 | A | 8/1999 | Jensen | |
| 5,947,215 | A * | 9/1999 | Lundell | E21B 10/567 175/417 |
| 5,984,030 | A * | 11/1999 | Larsson | E21B 10/36 175/414 |

(Continued)

*Primary Examiner* — Robert E Fuller

(74) *Attorney, Agent, or Firm* — Paul M Denk

(57) ABSTRACT

A polycrystalline diamond drill bit for percussion drilling, in small holes in high silica ground. The bits are made having a bit body, and a series of insets locating in the bit body, and the bits are made using a double chisel design, or a modified double chisel design. The inserts are set into the bit body at very specific angles. The inserts have specific lengths to provide cut clearance for the bit body. The cutting angle the and radius on the tip of each insert in addition to the diameter of the inserts, provide a machine thrust pressure and machine torque pressure at low ranges when the PCD bits are used in percussion drilling.

15 Claims, 5 Drawing Sheets

(56) References Cited

U.S. PATENT DOCUMENTS

| | | | | |
|---|---|---|---|---|
| D424,579 | S | 5/2000 | Brady | |
| D430,578 | S | 9/2000 | Brady | |
| 6,659,202 | B2 | 12/2003 | Runquist et al. | |
| D487,753 | S | 3/2004 | Brady | |
| D524,333 | S | 7/2006 | Brady | |
| 7,207,402 | B2 * | 4/2007 | Bjork | E21B 10/56 175/418 |
| D574,403 | S | 8/2008 | Brady | |
| 8,051,927 | B2 * | 11/2011 | Nava | E21B 10/36 166/242.6 |
| 2006/0180354 | A1 | 8/2006 | Belnap et al. | |
| 2008/0035387 | A1 | 2/2008 | Hall et al. | |
| 2009/0184564 | A1 | 7/2009 | Brady | |
| 2009/0260892 | A1 * | 10/2009 | Hisada | E21B 17/042 175/394 |
| 2010/0025114 | A1 | 2/2010 | Brady | |
| 2011/0042146 | A1 * | 2/2011 | Lachmann | E21B 10/46 175/414 |

* cited by examiner

BODY NOMENCLATURE

INSERT NOMENCLATURE

MODIFIED DOUBLE CHISEL DESIGN

DOUBLE CHISEL DESIGN

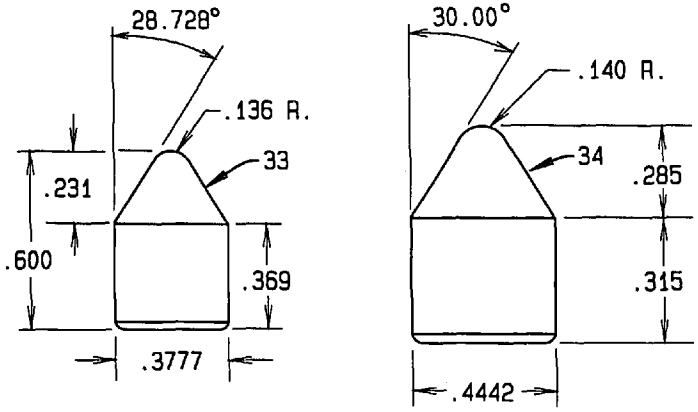
FIG. 7
FIG. 8
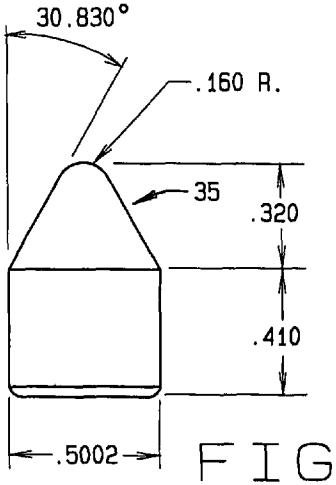
FIG. 9
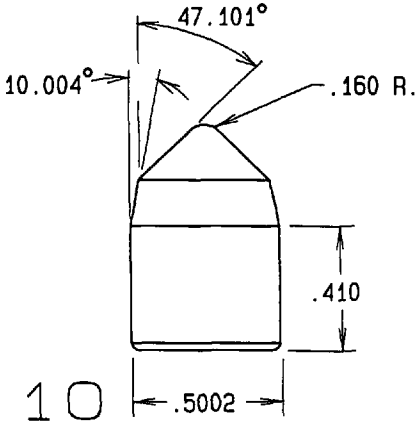
FIG. 10
| DIA. X LENGTH | TIP | GRIP | R. | IDEAL - R. |
|---|---|---|---|---|
| .3100 X .546 | .236 | .310 | .100 | .100 |
| .3777 X .560 | .220 | .360 | .145 | .135 - .145 |
| .3777 X .640 | .220 | .420 | .145 | |
| .4442 X .600 | .285 | .315 | .150 | .140 - .150 |
| .4442 X .650 | .285 | .365 | .150 | |
| .4442 X .785 | .285 | .500 | .150 | |
| .5002 X .685 | .300 | .485 | .165 | .160 - .165 |
| .5002 X .725 | .300 | .425 | .165 | |
| .5002 X .785 | .300 | .485 | .165 | |
FIG. 11

POLYCRYSTALLINE DIAMOND PERCUSSION DRILL BITS USING LOW THRUST AND TORQUE FOR APPLICATION WITH SMALL DIAMETER DRILL BITS

CROSS REFERENCE TO RELATED APPLICATION

This non-provisional patent application claims priority to the provisional patent application having Ser. No. 61/744,090 filed on Sep. 18, 2012, and claims priority to the continuation-in-part patent application having Ser. No. 12/550,093, filed on Aug. 28, 2009, which claims priority to the non-provisional patent application having Ser. No. 12/273,700, filed on Nov. 19, 2008, which claims priority to the provisional patent application having Ser. No. 61/022,614, filed on Jan. 22, 2008.

FIELD OF THE INVENTION

This invention relates to drill means, and more specifically to polycrystalline diamond drill bit means, for use for accelerating drilling, particularly within very hard rock, and high silica ground at very low thrust and torque ranges. This invention comprises very specific parameters for the drill bits and drill machine settings that comprise a system for drilling.

BACKGROUND OF THE INVENTION

Tungsten carbide drill bits have been used for drilling into soil and also hard rock, and have been available for many years, have been effective for their routine usage, but they do have a tendency to become dull, or fracture, particularly when drilling into hard rock.

Current tungsten carbide bits tend to dull down very fast in very hard, high silica ground, with a compressive strength of 30,000-60,000 psi.

The drill settings, when using tungsten carbide bits are generally set at 30 Bar or more for the thrust and torque for the first hole or two, then the thrust is increased to the maximum on the drill of approximately 50 Bar, to drive the dull bit into the rock.

Tungsten carbide bits cannot drill efficiently at very low thrust and torque settings in hard rock drilling applications, as the carbide inserts dull down severely, and stop the drill bit from penetrating the ground. Very high thrust and torque settings, sometimes up to 50 Bar, are required when drilling with these types of carbide bits.

The prior art and use of tungsten carbide insert bit designs has proven to be marginally satisfactory and the design and use of polycrystalline diamond (PCD) type inserts has substantially improved the performance of percussion drill bits. It has taken many years to perfect the design of the PCD bits, as a replacement for carbide tips, particularly since in the PCD bit structure, the range for the dimensions of the inserts, the bit bodies, and the drill settings, are very limited and narrow. Inserts used in prior art could have a very wide range of dimensions, and still be considered acceptable.

Prior art patents or publications include U.S. Pat. No. D574,403 and U.S. Publication No 2009/0184564. Other prior art patents relating to this technology include U.S. Pat. No. 5,944,129, in addition to U.S. Pat. No. 3,788,409.

As further commented, carbide bits operate at very high thrust and torque, usually in the range of 50 Bar or above for thrust and 30 Bar or above for torque, and their insert tip length is shorter, and there are many more inserts included in the bit body, than are required or needed in the PCD type of percussion drill bit. Carbide bits dull down fairly fast, particularly in abrasive rock, thus slowing down the penetration rate, and require an elevation of thrust and torque, in order to achieve any continuous drilling. Furthermore, it has been experienced that carbide bits wear down 10 to 15 times faster than a PCD drill bit, and are 30% to 50% slower in drilling penetration rates.

Through testing, it has been determined that the normal time to drill a 50 hole round within hard rock, using the carbide drill bit, was in excess of three hours, but utilizing a PCD insert drill bit, could achieve the same drilling of a 50 hole round in a time between about one hour and one and a half hours. PCD bits complete a drilling operation using 70% less thrust and 60% less torque.

The usage of PCD bits, in comparison to carbide bits, found that the PCD percussion drill bits were more productive; at far less thrust and torque parameters, than the carbide bits.

Furthermore, because there are fewer PCD bits to change out due to little or no dulling, during prolonged usage, there is a lesser chance of injuries to the miner, and workers handling such equipment.

Because of the reduction in thrust and torque forces required, up to approximately the 70% range, when drilling with PCD insert drill bits in comparison to the use of carbide bits, there is less heat buildup in the drill steel sections and there is a less torsional forces exerted on the steel sections that can cause fatigue and failure, and therefore, the drill steel section life of the entire equipment is vastly improved using the PCD insert bits.

Furthermore, because of the very low thrust and low torque that is used when drilling with PCD double chisel insert bits or modified double chisel bits, as has been found through experimentation, there is less stress on the hydraulic components of the machinery, that there is less wear on the drilling machine and there is less heat buildup in the drill steel sections, as explained when utilizing the PCD bits in comparison with carbide bits.

Finally, it was observed during experimentation, that the powder crews, when depositing their explosives within the drilled holes, that there was a very significant reduction of cuttings left in the hole that were drilled with the PCD bits as compared with the carbide bit drilled holes, and this resulted in significantly less time cleaning the holes with a spoon, during the performance of the crew's duties.

It can be seen that when compared to the prior art style of carbide bits, that the PCD bits have far more advantages, which have been identified during experimentation and testing, at very significant cost reduction advantages for the mine. Production is nearly doubled with the use of the PCD drill bit. The bit cost per foot of hole is reduced, drilling time of the holes is significantly reduced and maintenance costs are minimized.

SUMMARY OF THE INVENTION

This invention contemplates the formation of polycrystalline diamond percussion drill bits with conical inserts, and with a double chisel or modified double chisel cutting face, designed to reduce the cost of drilling and improve drilling penetration rates over the older tungsten carbide bits. With the PCD double chisel bit design, the machine thrust pressure is lowered to 10 bar-20 bar max, and the machine torque pressure is reduced to 8 bar-15 bar max. At these drill settings, the thrust is reduced 70% and torque is reduced 60%, the PCD drill bits continue to drill every hole at about the same speed. The PCD bits stay sharp and show very little or no dulling, even after drilling hundreds of feet of hole into high silica ground. The low thrust and torque settings are exclusive for PCD diamond insert percussion drill bits only, to attain maximum penetration rates and maximum bit life. The invention described herein generally relates to small diameter PCD percussion drill bits in the range generally between about 1¼" to 3½" diameters.

Three-winging and four-winging bits were tested using the PCD inserts, and were made similar to bits made with tungsten carbide inserts. These PCD bits designs either failed or drilled slower. The two wing double chisel bit design was then tried and the results were outstanding and completely unexpected. The penetration rates achieved were two to four times faster, and the life was 10 to 15 times longer than the carbide bits, and the inserts showed little or no dulling or wear even after drilling over 450 feet of hole in the extremely hard, high silica ground.

PCD bits with bigger inserts and the larger specific range of radius on the tip of the conical insert was tested several times. The PCD bits made with the larger inserts and larger radius on the tip of the inserts drilled 40% slower than the PCD bits made with a sharper tip. If the tip is too sharp, there is insert failure due to shearing of the insert tip. If the tip is to blunt, it acts like a dull carbide tip. The dimension range is narrow for these PCD inserts of this invention.

After testing of various dimensions for the PCD inserts, the parameters where established for the inserts and the bit bodies. There is a narrow range for the inserts, and bit body dimensions, and they need to all be balanced with the parameters set for the low thrust and low torque settings on the drill, to attain maximum performance.

A PCD diamond percussion drill bit means can be used for blast hole drilling and roof bolt drilling. The PCD drill bit is the only drill bit to use extremely low thrust and low torque when drilling very hard, high silica rock. The PCD drill bits have the following advantages:

1. PCD bits are more productive than carbide bits and show little or no dulling wear on the inserts.
2. PCD bits drill 2-4 times faster than carbide bits.
3. PCD bits last 10-15 times longer than carbide bits.
4. Regarding safety, PCD bits reduce hand injuries, because fewer bit changes are required.
5. The drill steel, striking bar and coupling life is increased because of the low thrust and torque used when drilling with PCD drill bits.
6. There is reduced maintenance of the drill because of the low thrust and low torque requirements.
7. Bit costs and drilling costs are reduced because of the high footage attained on the PCD percussion drill bits and the fast penetration rate achieved.

The present invention shows how critical dimensions are when drilling with PCD inserts. With the proper dimensions, thrust and torque set to the proper settings, the PCD double chisel and modified double chisel designed bits have proven to exceed the performance of all prior art designs.

And in the design of PCD inserts, when the inserts are made with a 0.010-0.030 inch thick PCD coating of diamond on the tip of the insert, the following ranges have been found for the design and manufacture of the percussion drill bit for their effective applications:

| Range Claimed for Inserts | Range Dimensions | Optimal Dimensions |
|---|---|---|
| OAL of Insert | .490"-.650" | .543"-.600" |
| Diameter of Insert | .3000"-.4200" | .3100" or .3777" |
| Tip Length | .200"-.260" | .215"-.245" |
| Tip Angle | 15.00°-35.00° | 15°-30.00° |
| Tip Radius | .100"R-.145"R | .115"R-136"R |
| Grip Length | .290"-.420" | .313"-.400" |

Some bits require more than one length of Insert for assembly

| Range Claimed for Inserts | Range Dimensions | Optimal Dimensions |
|---|---|---|
| OAL of Insert | .600"-.750" | .685" |
| Diameter of Insert | .3900"-.4900" | .4442" |
| Tip Length | .250"-.350" | .315" |
| Tip Angle | 15.00°-35.00° | 20.00°-30.00° |
| Tip Radius | .120"R-.155"R | .136"R |
| Grip Length | .300"-.450" | .357"-.450" |

Some bits require more than one length of Insert for assembly

| Range Claimed for Inserts | Range Dimensions | Optimal Dimensions |
|---|---|---|
| OAL of Insert | .625"-.785" | .685" |
| Diameter of Insert | .4800"-.5200" | .5002" |
| Tip Length | .260"-.335" | .300"-.310" |
| Tip Angle | 28.00°-40.00° | .28°-32.00° |
| Tip Radius | .135"R-.170"R | .150"R |
| Grip Length | .330"-.550" | .435"-.600" |

Some bits require more than one length of Insert to make them

After considerable research and development, the critical insert and PCD bit dimensions where established for the drill bits as described herein, and then the drill setting parameters where established, as shown, through such experimentation. The drill settings are set far below what a carbide bit can operate effectively at, and this was not obvious to this inventor, in determining what the parameters should be. Carbide bits in hard, high silica rock need at least 30 bar of machine thrust pressure, and 30 bar of machine torque pressure, to drill the first couple of holes. As they dull down, the machine thrust pressure needs to be increased to 50 bar. The PCD double chisel bit design, to be described herein, required only 8 to 15 bar of machine torque pressure, and 12 to 15 bar of machine thrust pressure, to drill with maximum penetration rates and efficiency. Thus, drilling with the PCD insert drill bits takes about 70% less thrust, and 60% less torque than a carbide bit. PCD bits were found to drill two to four times faster than the carbide bits, and are capable of drilling, and they do it with far less thrust and torque. This unique feature of very low thrust and very low torque when drilling with PCD insert percussion drill bits is a significant improvement in this art. Carbide bits can not perform well at these low settings, and when they get slightly dull, the carbide bits will just slow or stop penetrating the rock at these low settings and will just spin in the drilled hole. These very low drill settings are unique for drilling with the PCD insert bits only.

As explained in the ranges listed above, the combination of features that are unique to bits made with PCD inserts, and the drill settings are as follows. The PCD insert tip length is significant. The PCD insert tip radius is significant. The PCD insert tip angle is critical. The PCD insert grip length is necessary. The bit body gauge angle in combination with the tip length requires careful analysis when making the PCD insert. For the invention herein, the double chisel design has been found most effective when used on bits from the 1¼" inch to 2¼" inch in gauge sizes. The modified double chisel design when used on bits from 2½ inches to 3½ inches gauge sizes is essential for maximum and outstanding performance. The drill settings, as previously explained, for machine torque pressure, should be set and 8 to 15 bar maximum. The machine thrust pressure setting is set at 12 to 15 bar maximum, during a drilling performance.

When the parameters are established for the PCD inserts, in the formation of the bits, during their usage, it has been found that the inserts stay very sharp even after drilling hundreds of feet of hole in high silica, high compressive strength rock, achieving such even at these types of low torque and thrust settings.

In the inventor's fifty-four years of designing carbide rotary and percussion drill bits, he has never seen a percussion drill bit made that compares to the percussion PCD double chisel bit design for performance as described herein. The specific body angles, the PCD inserts with very specific lengths, tops, angles and radii, have performed extremely well, and far outperform the carbide inserts which were/are standard in the art. The double chisel bit design requires that a very low torque and very low thrust be used to drill efficiently, and at these low levels of operation, the bits just do not wear out, and have a far more extended life than what can be obtained from a carbide type of bit. Percussion bits made with PCD inserts using the specific insert dimensions, bit bodies, and all the other dimensions identified herein, are believed to be quite unique in the art, and have proven to out perform carbide bits, particularly when used for drilling continuously in hard rock.

It is, therefore, the principle object of this invention to provide a polycrystalline diamond percussion drill bit, where its inserts are formed within specific ranges of dimensions that have been found, through research and testing, to provide the most effective and efficient percussion bit particularly when used for drilling within high silica or hard rock ground.

Another object of this invention is to provide a designed bit body for a drill bit in which precisely manufactured and mounted polycrystalline diamond inserts are located to provide a bit for high efficiency usage.

Another object of this invention is to form and provide drill bits that produce double chisel or modified double chisel cutting effects in usage.

These and other objects may become more apparent to those skilled in the art upon review of the summary of the invention as provided herein, and upon undertaking a study of the description of its preferred embodiments, in view of the drawings.

BRIEF DESCRIPTION OF THE DRAWINGS

In referring to the drawings,

FIG. 7 shows a side view of an insert and bit and the parameters selected for its design;

FIG. 8 shows a side view of an insert and bit and disclosing the dimensions for its particular design;

FIG. 9 shows a side view of an insert and bit of a particular dimensional design;

FIG. 10 shows a double beveled insert design;

FIG. 11 shows the relative dimensions for the PCD bits of this improvement;

DESCRIPTION OF THE PREFERRED EMBODIMENT

Figure 1:
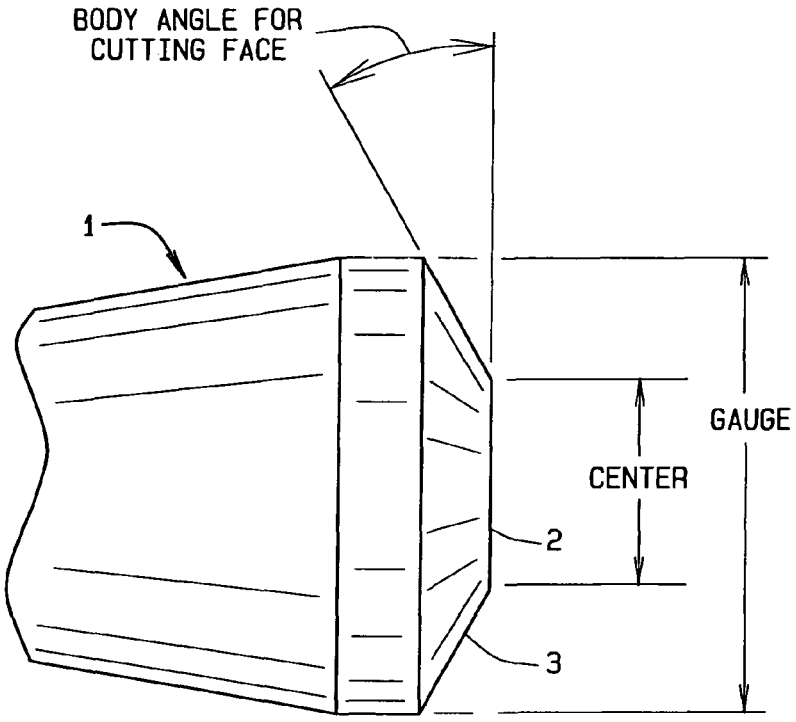
FIG. 1 is a partial side view of a bit body showing its various parameters.

In referring to the drawings, and particularly FIG. 1, therein is shown a part of the bit body that is applied to the drill shaft for the drilling system, and it discloses the general parameters for the shape of the cutting face for the bit, when it is manufactured and assembled. As can be seen, the body 1 includes its cutting face 2 and has a beveled angle for the cutting face, as noted at 3, which surrounds the circumference of the said cutting face. The various parameters for the body angle, the gauged diameter, and the center face for the cutting face, are shown and described herein.

Figure 2:
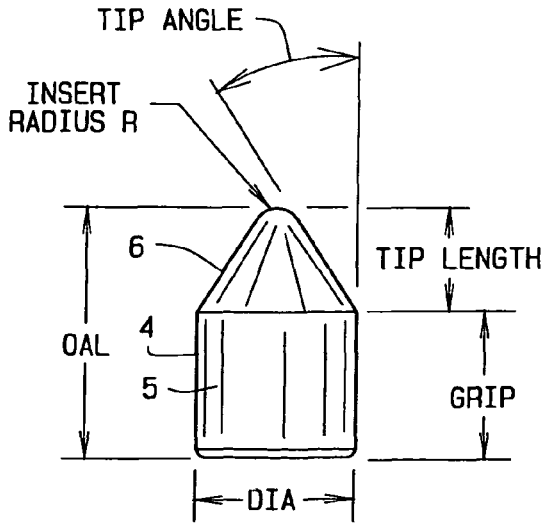
FIG. 2 provides a side view of an insert, of the polycrystalline diamond type, for application to the front surface or cutting face of the bit body, of FIG. 1.

FIG. 2 shows an example of a PCD insert 4, and the inserts, for this embodiment, include a gripping portion 5 which is generally formed of tungsten carbide, and the parameters for its dimension can be seen as summarized and as noted. The formed tip 6 for the insert, and the concept of this invention, is the high pressure formation and application of the polycrystalline diamond structure to the insert tip, as to be noted. The insert tip is applied by high pressure and heat to the tungsten carbide grip portion of the insert, and it is formed to very specific radiuses, at its tip, and has specific tip angles, in addition to length, all as previously summarized when identifying the ranges for the formation of the inserts, their tip length, tip angles, tip radius, and grip length. The overall diameters for the inserts were also reviewed, as previously summarized.

Figure 3:
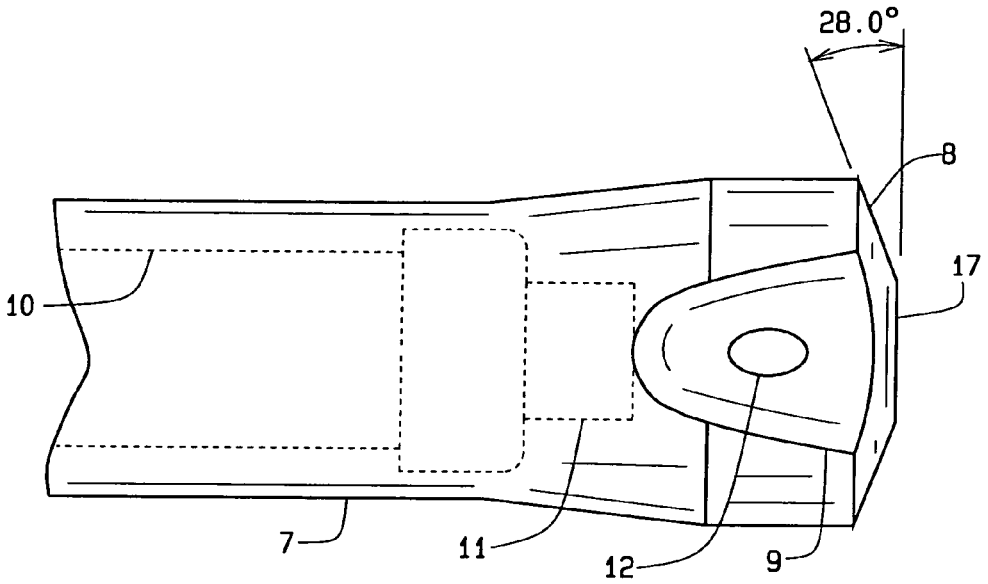
FIG. 3 shows a complete side view of a bit body disclosing its cutting face at one end, and the at least one of the discharge ports for the application of cleaning fluid, or water, used to flush out the drilled hole during drilling.
Figure 4:
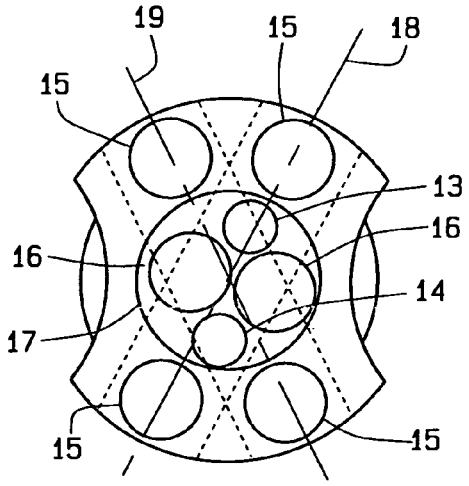
FIG. 4 provides a front view of a cutting face, showing various holes for holding the PCD inserts, and a location of select fluid delivering openings.

FIG. 3 shows an entire bit body 7 and also discloses the cutting face 8, in addition to the concave clearance portions 9 for the shown bit. Internally of the body is a cavity 10 that communicates with a reduced diameter aperture 11, which conveys the cleaning fluids, such as water, to the forward portion of the bit, and exists under pressure from select apertures, such as the side opening 12 as noted within the side of the bit. As can be seen in FIG. 4, there are also a pair of openings 13 and 14 formed through the cutting face, that also allows the discharge of fluid, such as water, under pressure, to help clear out the cutting debris, formed during a drilling operation, and force it to flow upwardly along the concaved cavities 9, and up the sides of the drill shaft, for discharge from the hole being drilled, during its drilling operation.

More specifically, with respect to FIG. 4, the various insert holes 15 are shown, provided within the angled portion of the cutting face, and these are the openings into which the various PCD inserts are press fitted, in preparation for usage of the bit in a drilling operation. There is also a pair of holes 16, provided within the front of the cutting face, as at 17, and PCD inserts are located therein, through pressure application, when preparing the bit for a drilling operation.

More particularly, the location of the inserts particularly upon the face of the drill bit body is rather important. It is desirable, and most effective in a drilling operation, to have each insert cutting rock around a perimeter off of the central axis of the bit body that is different from the radius of all of the other face inserts in operation. In that manner, each insert will be cutting rock independently, and not merely attempting to cut within the same groove formed by the previous insert in the rotation of the drill bit during a drilling operation. While it has been found not necessary, it may be that the inserts located upon the sloping portion of the bit body face may also be at differing radii, to attain the same effect during a drilling operation. Examples of the distance from the centerline or central axis for the drill bit body, and the radius of the insert from the centerline, may be seen from the following chart.

| Drill Bit Size | No of face Inserts | Distance from C/L |
|---|---|---|
| 1⅜ | 1 | ⅛" |
| 1¾ | 2 | 3/16"-5/16" |
| 2" | 2 | ⅜"-7/16" |
| 2¼ | 2 | ⅜"-7/16" |
| 2½ | 3 | ⅜"-7/16"-½" |
| 3.0 | 4 | ⅜"-½"-13/16"- |
| 3½ | | 1.0" |

As can be noted in FIG. 4, there are various angular relationships between the location of the various inserts, when inserted therein, and the alignment of these inserts generally define a chisel alignment, as can be seen for the alignments of the inserts along the linear length 18, in addition to the non-linear alignments 19 of the inserts along that dimension, and the two linear alignments form what is herein called as the double chisel or modified double chisel cutting face for the formed body.

Figure 5:
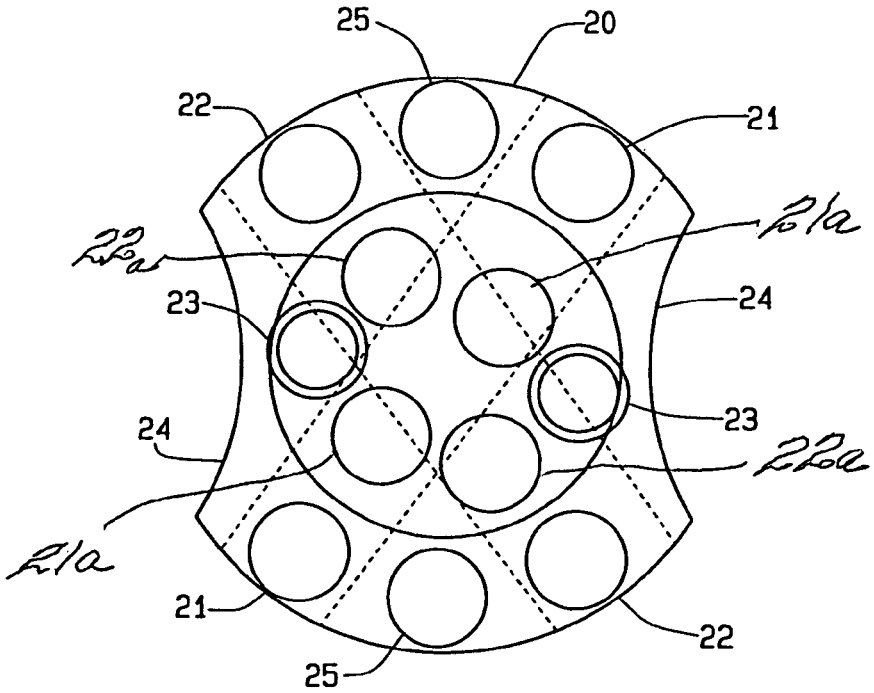
FIG. 5 shows an example of a modified double chisel cutting face for a bit.

FIG. 5 shows an example of a modified double chisel design, as noted at 20, and the non-linear alignment of the inserts 21, that form one chisel for the bit face, while the non-linear alignment of the inserts as along 22 form another chisel alignment of the PCD bits, when manufactured into a usable drill bit. This design also shows the fluid openings 23 that discharge water, under pressure, out the front face of the bit, and in addition, the bit design also discloses the concaved clearance areas 24 which also include the type of openings, as previously explained at 12, where fluid may discharge therefrom, and aid in the removal of any drilling debris, generated during a drilling operation, and force it under fluid pressure up the drilled hole, along the drill shaft, and out at the ground surface for removal. The inserts 21*a* and 22*a* are the center cut inserts that locate upon the flat face of the drill bit, as shown. In addition, this modified bit 20 includes an extra insert, one on both sides of the PCD bit, as noted at 25, and are provided to add to the cutting face of the PCD bit, forming the modified double chisel design using the PCD inserts, such as the one described in FIG. 2, with very specific cutting tips made to the parameters, angles, and designs as previously summarized for the ranges of bits manufactured. For example, there are inserts that are formed including inserts that may be of an overall length range of 0.490"-0.650", with the ideal dimensions being somewhere within the range of 0.543"-0.600" as previously reviewed. In addition, the inserts will be formed having their various diameters, lengths, and tip angles, tip radiuses, and grip length, as specified and summarized previously. These provide the optimum design for the most effective drill bits designed for usage of this invention. Also for some of the bits, the inserts may have more than one length and even more than one diameter.

Figure 6:
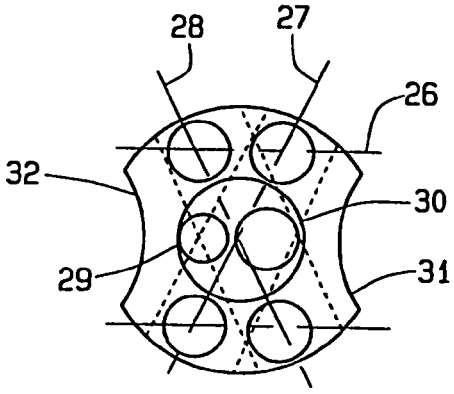
FIG. 6 shows an example of a double chisel cutting face design for a PCD insert.

FIG. 6 shows a further variation upon a double chisel design, as at 26, and which accepts the PCD inserts, in this particular instance, for a 1⅜ inch diameter drill bit. One can see how the formed arrangement of the aligned chisels, holding in alignment their particular PCD inserts; can be seen upon the alignments 27 and 28, for the formed drill bit. In addition, the fluid conducting aperture 29 can be noted, for discharging water for removal of drilling debris, at the front face 30 for the shown bit. In addition, the side cavities 31 and 32, having their water discharge apertures (not shown), similar to that as described in FIG. 3, are provided laterally of the formed bit.

What can particularly be noted from the various apertures or openings that are provided within both the face of the bit body, and its sloping cutting face 8, and as also can be seen in FIGS. 4, 5 and 6, the arrangement of the location of the PCD inserts within the body are arranged of a particular design. This arrangement forms what is described as the chisel alignment of the inserts, which may form the double chisel design, as noted in FIG. 6, or the modified double chisel design, as can be seen in FIG. 5. What is to be noted is that no insert locates at the central axis of the bit body, in their patterned arrangement. Secondly, all of the center face inserts are placed asymmetrically with the central axis of the bit body 7. Furthermore, each insert has a radius dimension from the center of the bit body that is different from all of the other inserts. This is essentially so with respect to the inserts provided into the face 2 of the of the bit body. Furthermore, as stated, at least two or three of each of the inserts are in alignment for forming the asymmetrical off centered chisel arrangement for the inserts, or a plurality of the inserts may be located in general non-alignment, for forming the double chisel design, and the modified double chisel design, as explained herein. The reason for this is that each PCD insert provides its own select path for grinding of the rock, during a percussion drilling operation, and therefore, each insert provides a different cutting path into the rock formation, during a drilling operation, which greatly accelerates the drilling into the rock formation, and furthermore, since the inserts are capped with the polycrystalline diamond drilling surface, provides a hardness that can drill into the rock, without significant wear thereon. Each insert is made with approximately a 0.010-0.030 thick PCD coating of as sintered diamond (unpolished) applied onto the top of the insert. This is essential to the highly efficient drilling operation achieved from the type of inserts as described herein, and the arrangement of their formation upon the bit body, both on its cutting face, and its angulated circumferential outer surface, as can be seen and as described herein. The significant enhancements obtained from forming the entire bit body 7, as described herein, and as already summarized, have produced results that have just not been obtainable heretofore.

FIGS. 7-9 disclose specific dimensions for the PCD inserts, generally along the lines for formation of the insert as previously reviewed with respect to FIG. 2. For example, the insert 33 is of a diameter of approximately 0.3777 inch, as noted. All of its other parameters, including the tip angle, tip length, grip length, in addition to overall length (OAL) are also noted.

FIG. 8 shows a PCD tip 34, of an approximate diameter of 0.4442 inches. FIG. 9 shows a PCD tip 35, in the manner of the tip as formed in FIG. 2, as described, and in this instance it has a diameter of approximately 0.5002 inch, when manufactured. All of the other dimensions for these formed PCD tips can be seen in the chart as set forth in FIG. 10.

The drill setting parameters for drilling with PCD inserts in small, 1¼"-3½ drill bits is shown. The drill parameters are extremely critical to prevent insert breakage and are mandatory when using PCD insert drill bits. These low settings are unique for drilling with PCD insert drill bits. No carbide bit can drill efficiently at these low settings in hard ground. Thrust and torque pressures are set to a minimum on the drill. Attained machine torque pressure at a range of 8-15 bar, and for the machine thrust pressure at a range of 10-20 bar is sufficient. Carbide bits require a range of 30-50 bar of machine thrust pressure, and 25-30 bar of machine torque pressure.

A double chisel bit design is used with PCD inserts in bits sizes from 1¼"-2¼" and a modified double chisel bit design is used in the 2½"-3½" percussion drill bits sizes.

At least, two air holes in size from 0.25" in diameter in the small 1¼"-1⅝" drill bits, and 3-4 holes from 0.312"-0.437" in diameter in all of the bits above the 1⅝" size are required.

It is absolutely imperative to have the largest air holes possible in each bit, to flush the cuttings from the drilled hole and to keep the PCD diamond inserts cooled, to prevent deterioration of the PCD diamond due to heat. Small air/water holes tend to leave a large amount of cuttings in the hole, resulting in slower penetration rates, time lost cleaning the hole with a spoon, high bit body wear and overheating of the drill bit. Bits in sizes from 2"-3½" need to have a minimum of four air holes drilled into the bit body. Two on the sides of the bit and at least two in the face of the bit that is countersunk.

Initial testing of 1⅜" PCD insert percussion drill bits is ongoing and continues to date. During the early testing period, tests were conducted using thrust and torque settings for carbide bits. The initial tests were in very hard, 60,000 psi compressive strength, sandstone rock at the Mettiki coal mine near Oakland, Md. The early PCD bits tested drilled as much as 50, 6' holes, where the carbide bits could only drill about 7-6' holes.

An attempt to make larger PCD insert percussion drill bits was done in sizes from 2"-3½". Testing at the Newmont, Leeville, mine in Nevada was started and conducted over a period of time. The 2" percussion PCD drill bits were able to drill this very hard ground two to four times faster than a carbide bit. The inserts never got dull after drilling 44,—12' ft holes, 428' of hole, whereas, the carbide bits, could only drill from 2-7—12' ft holes before they either failed or drilled so slow that they needed to be changed out and replaced with a new bit.

Penetration rates for the 2" carbide bits was from 2.59 minutes at 30 bar of machine thrust pressure and 30 bar of machine torque pressure on the first 12' hole drilled and 6.25 minutes per hole when the bit had dulled and the machine thrust pressure needed to be increased to 50 bar of machine thrust pressure and 30 bar of machine torque pressure to get the carbide bit to penetrate the ground.

Penetration rates for the 2" PCD bit in most every hole drilled, ranged from 1.27 minutes with a very few holes taking 1.53 minutes to drill. The drill was set initially at 30 bar of machine thrust pressure and 30 bar of machine torque pressure. We encountered insert breakage and it took further testing before one arrived at the parameters that made it possible to drill with PCD inserts and not have the catastrophic insert failure we experienced at the initial thrust and torque settings.

By setting the drill as low as possible on the thrust and torque, we found that the PCD bits, drilled faster and the requirement for torque were minimal. We had planned to lower the drill down to 12 bar of machine torque pressure and 12-15 bar of machine thrust pressure. Due to the bad maintenance on the drills, the adjustment valves would only allow us to reduce the machine torque pressure to 15 bar and 15 bar on the machine thrust pressure. At these settings, the PCD bits never experienced insert breakage, the results were outstanding. Lower torque settings were tried later and found to be even better for the PCD insert bit life and penetration rates. The penetration rate was from 50%-80% faster, than drilling with a carbide bit, using the low settings for torque and thrust.

Parameters Identified for Drilling with PCD Insert Percussion Drill Bits Thrust:

Settings from 10-15 bar with an extreme max upper limit of 20 bar. Anything above 20 bar, the thrust causes the inserts to penetrate the ground too deep and the torque on the drill shears off the tips of the inserts. Ideal settings 10-15 bar. One should use the lowest setting possible.

Torque:

Settings of 8-15 bar are recommended, with 15 being the extreme upper limit with a maximum machine thrust pressure of 15 bar. Always use the lowest settings possible.

The very low thrust and torque drill settings are unique, for drilling with PCD insert drill bits, they are too low for a carbide bit to drill efficiently with, and were only discovered after "trial and error" to determine why the PCD inserts continually failed. The PCD bits were made a success by identifying the parameters of thrust and torque necessary to drill efficiently with PCD inserts. Carbide bits cannot drill the hard rock ground with the very low drill settings for the PCD bits. The drill settings are unique for PCD bits only. They have never been used or identified before.

The design of the PCD insert 2" drill bits is a double chisel design. This 2" PCD insert design comprises four inserts on the outer gauge of the bit with two inserts in the center of the bit to make a double chisel action drill bit. From observations of the drilling, it was found that the design actually allowed the PCD drill bits to drill faster, clean the whole better and show minimal wear on the bit body in the highly abrasive ground that the testing was conducted in. Because of the length of the tip of the inserts, and the open sides of the double chisel design and the four large 0.312-0.375 diameters flushing holes, faster penetration and better cleaning of the hole was achieved. Carbide bits general have a round full face and shorter insert tips with nine inserts in the face of the bit, smaller air holes and less flushing area to rid the drilled hole of cuttings.

The double chisel design of the PCD bit was a surprise because one was attempting to keep the cost per bit down by using a minimum number of very expensive PCD inserts. This design in carbide would not work in abrasive ground as there needs to be more carbide inserts on the gauge area to retard dulling. The features of the parameters required for drilling with PCD insert percussion drill bits was an innovation. Bits tried early in the development were the four wing bit and the three wing bit as in gauge sizes from 1⅜"-1⅝". The three wing carbide bits tested, had only four inserts but were not fast in drilling, in 70% silica and 65,000 psi compressive strength sandstone rock. The four wing bits were similar as they did not perform as well as expected and were slower drilling.

The PCD double chisel bit design defied all logic for performance and used the least number of inserts. This PCD bit design and the performances of the 2" double chisel design, was not expected, and now, the entire line of PCD drill bits from 1¼"-2¼" shall use the same double chisel design, but the 2½"-3½" PCD bits shall use a modified double chisel design. All bits use a 20°-40° gauge angle on the body to attain gauge clearance of the bit body depending on the insert tip length used. The inserts in the center of the bit are arranged to achieve a double or modified double chisel cutting action and are in a non-tracking positions. They are nonsymmetrical in radius from the center of the bit. The PCD insert diameter for the 1½"-1¾" bits is a 0.3777" diameter insert that is 0.540-0.650 long with a single angle PCD tip for cutting. (See FIG. 10). The 1⅞"-2½" gauge bits use a 0.4442" diameter insert that is from 0.540"-0.784" in OAL. The 2¾"-3½" gauge size bits use a 0.5002 diameter insert that is 0.650"-0.750" long with a single angle tip for cutting.

The cutting tip of the PCD inserts is the most critical dimension of the bit. The tip needs to be long enough to cut clearance for the bit body while maintaining structural integrity. The tip length on the 0.3777" diameter inserts needs to be from 0.230"-0.260" in length. The tip on the 0.4442" diameter inserts needs to be 0.290"-0.320" in length and the tip length on the 0.5002" diameter inserts needs to be from 0.300"-0.325" in length. These dimensions have proven to be the most effective dimensions tested and are vital to maximizing penetration rates, bit life, and reducing wear and drag on the bit body. The radius on the nose of the tip should be 0.136"R on the 0.3777" diameter, and 0.4442" diameter inserts. The radius on the nose of the 0.5002" diameter inserts as tested was a 1.50"R. The 2" bits made with these inserts drilled about a minute slower than the bits made with the 0.136"R radius nose. The larger cutting radius retarded penetration rates. Where one uses larger drills with more impact force on the bit, the 0.150"R in the 2¾"-3½" gauge size bits works well. There needs to be a balance between the drill and the design of the PCD inserts used in the percussion drill bits.

FIG. 11 shows the preferred parameters for the inserts where the overall length may be 0.600 inches, and another having an overall length of 0.543 inches in dimension. The 0.600 inch overall length is shown and described in FIG. 7.

To provide even more specific ranges for the various dimensions for the conical PCD inserts, the following dimensions set forth the preferred dimensions for inserts having the diameters provided within the ranges specified, as follows:

1. A 0.3100"-0.4000" dia. PCD conical insert that has a tip length of 0.230", a grip length of 0.370" and a cutting angle of 28 to 35 degrees with a tip radius of 0.120"R to 0.136"R
2. A 0.3500"-0.4000" dia. PCD conical insert that has a tip length of 0.230", a grip length of 0.420" and a cutting angle of 28 to 35 degrees with a tip radius of 0.120"R to 0.136"R
3. A 0.4000"-0.4500" dia. PCD conical insert that has a tip length of 0.285", a grip length of 0.315" and a cutting angle of 28 to 35 degrees with a tip radius of 0.120"R to 0.150"R
4. A 0.4000"-0.4500" dia. PCD conical insert that has a tip length of 0.310", a grip length of 0.365" and a cutting angle of 28 to 35 degrees with a tip radius of 0.120"R to 0.150"R
5. A 0.4000"-0.4500" dia. PCD conical insert that has a tip length of 0.310", a grip length of 0.500" and a cutting angle of 28 to 35 degrees with a tip radius of 0.120"R to 0.150"R
6. A 0.4800"-0.5200" dia. PCD conical insert that has a tip length of 0.320", a grip length of 0.365" and a cutting angle of 30 to 35 degrees with a tip radius of 0.150"R to 0.165"R
7. A 0.4800"-0.5200" dia. PCD conical insert that has a tip length of 0.320", a grip length of 0.405" and a cutting angle of 30 to 35 degrees with a tip radius of 0.150"R to 0.165"R
8. A 0.4800"-0.5200" dia. PCD conical insert that has a tip length of 0.320", a grip length of 0.470" and a cutting angle of 30 to 35 degrees with a tip radius of 0.150"R to 0.165"R A bit body with a sloped outer gauge area for placing the gauge cutting PCD diamond inserts. The slope angle on the bit body in a range of 25 to 35 degrees.

The low thrust settings on a drilling machine, in a range of 10 bar to 20 bar when using PCD insert percussion drill bits.

The low torque settings on a drill machine, in a range of 8 bar to 15 bar when using PCD insert percussion drill bits.

Figure 12:
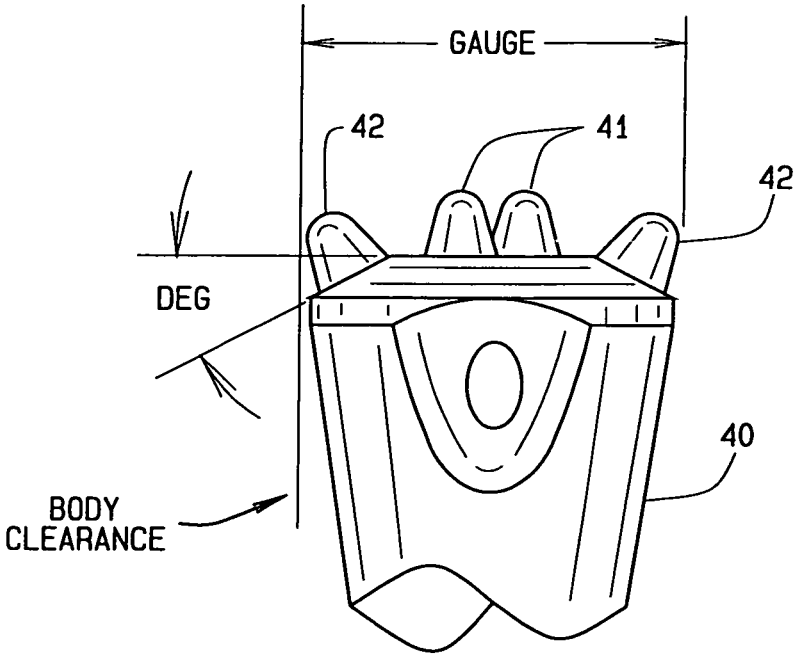
FIG. 12 provides a side view of the double chisel bit design.

As noted in FIG. 12, therein is provided a side view of the double chisel bit design of this invention, including disclosure of its drill bit body 40 with a series of PCD inserts 41 provided upon its upper face, and the PCD inserts 42 that locate upon the sloping portion of the double wing type of bit body, as noted.

Figure 13:
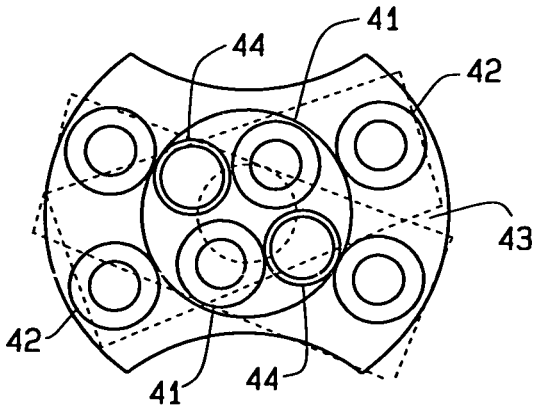
FIG. 13 is a top view showing the double chisel bit design with symmetrical gauge cutters and asymmetrical center face cutters, as shown.

In addition, FIG. 13 provides a top view of the double chisel bit design of FIG. 12, disclosing the PCD inserts 42 arranged around the beveled surface of the cutting face, as shown at 43, and the location of the inserts 41 provided upon the cutting face of the bit body. It can be seen that the inserts 41 are asymmetrical in location, and have differing radii from the central axis of the drill body 40. Also shown are the fluid openings 44 through which the fluids, such as water, is discharged to clear out the cutting debris.

Further testing of PCD percussion drill bits indicates that they can operate effectively with a machine thrust pressure rate of 15 bar, as long as the machine torque pressure is reduced to 8 to 15 bar maximum. 12 bar maximum is preferred. These are very low ranges for percussion drill bits. Previous tests indicated that the machine thrust pressure could be as high as 20 bar, but this higher thrust did result in the inserts penetrating far deeper than required, resulting in insert failure, particularly where the machine torque pressure may have been set at 20 plus bar during testing. A maximum penetration rate of the PCD drill bits of 3.5 m/min was obtained when the machine thrust pressure was set at 16 bar and the machine torque pressure was set at 12 bar. Machine thrust pressure settings beyond 16 bar tended to slow down the penetration rate by a few seconds, caused the inserts to be driven deeper into the rock strata, in softer formations, and thereby increased the potential of insert breakage by a high torque. Breakage will definitely occur, it has been found, if the machine torque pressure is not reduced to 8 bar-15 bar maximum. These are levels that were never considered with prior art percussion drilling.

As previously reviewed, the polycrystalline diamond inserts do need to have very specific dimensions, as set forth in the various tables previously reviewed, as for example, tip length, tip angle, and tip radius, to attain maximum performance and penetration rates, must be closely followed. Bit body angles for the outer gauge cutting PCD inserts needs to be set at specific angles, as detailed in these tables.

On all chisel PCD bit designs, in sizes from 1⅜" inch to 1⅝" inch, the air holes need to be 0.250 inches in diameter, and there needs to be two side holes, and one hole in the face of the bit body, to make it work effectively. On all PCD bits and sizes from 1¾" inch to 2½" inch gauge, there needs to be at least four air/water holes, as they need to be as large as possible to adequately flush the cuttings from the drilled hole. These holes need to be a combination of 0.250 inches, 0.312 inches, and 0.4375 inches in diameter. On PCD bits that range in size from 2¾" inch to 3½" inch diameters, there needs to be five, six or seven air/water holes in the bit body, and these holes need to be in a range of sizes from 0.375 inches to 0.437 inches in diameter. On all PCD bits, it is suggested to always use the largest holes possible to facilitate cleaning of the hole of the drilled cuttings. This reduces abrasive wear on the bit body, and aids in faster penetration rates by not having to re-drill cuttings in the hole.

PCD bits use a machine thrust pressure of up to 20 bar and a machine torque pressure of 12 bar max, the insert tips are longer and they show no wear in very hard and highly abrasive rock strata. PCD percussion drill bits drill 30%-50% faster than carbide bits, when tested side by side on the same drill. Carbide bits can not drill efficiently at the low thrust and torque settings used and required for the PCD drill bits in hard rock ground. After testing, and observing the PCD chisel and modified chisel bit designs as described herein, it has become evident that if percussion PCD bits are used and the parameters are set to the established settings, and the inserts and bit bodies have the established and recommended dimensions, and there is adequate air/water for flushing of the drilled hole, then using this unique system of low thrust and low torque for percussion drilling with PCD insert percussion drill bits is unique to the drilling world. If only parts of this system are used, separately, there will be some efficiency lost in the operation.

All of the bits in the PCD line are designed with a double chisel or modified double chisel design to maximize penetration rates, increase bit life, and reduce cuttings left in the hole and to reduce bit body wear. The combination of the double chisel design, the tip length and smaller radius on the nose of the inserts, are what made these drill bits effective and drill 12' holes 2-4 times faster than carbide bits on every test conducted.

Variations or modifications to the subject matter of this invention may occur to those skilled in the art upon review of the invention as described herein. Such variations, if within the spirit of this invention, are intended to be encompassed within the scope of any claims to patent protection issuing hereon. The description of the preferred embodiment, and its depiction in the drawings, are set forth for illustrative purposes only.

I claim:

1. A percussion drill bit, said drill bit formed having a body, the body capable of being secured with a drill shaft in preparation for a percussion drilling operation, the body having a center axis and a cutting face, the cutting face having a frontal flat face, and a beveled face extending outwardly radially therefrom, the body and the cutting face being integrally formed;

said drill bit formed of a double chisel design or modified double chisel design configuration;

said drill bit capable of operating at a machine torque pressure of less than 20 bar, and at a machine thrust pressure of less than 20 bar;

said frontal face and said beveled face having a series of openings provided therein, and inserts being press fitted within said openings in preparation for usage of the drill bit in said drilling operation, each of said inserts having a tip comprising a polycrystalline diamond coating;

select of said inserts providing a first set of inserts and others of said inserts forming a second set of inserts;

said first set of inserts having a first approximately linear alignment and offset from the center axis of said bit body, and said second set of inserts having a second approximately linear alignment and also offset from the center axis of said bit body, said first and second sets of inserts forming wings of a double chisel, the first and second alignments being at an angle relative to each other;

each insert provided in the cutting face of the drill bit positioned at a different radius from the center axis of said bit body than all of the other inserts provided upon said cutting face of the drill bit, each insert in the cutting face being non-tracking relative to all of the other inserts provided upon said cutting face of the drill bit;

said drill bit body having a gauge diameter between about 1¼" inches to 3½" inches;

each insert being of conical shape; and each insert having a gripping portion of a diameter between about 0.300 inches to 0.520 inches, each insert having a grip length of between about 0.290 inches and 0.550 inches, and each tip of each insert having a length of between about 0.200 inches to 0.320 inches, and a conical surface of each tip formed at an angle from the insert grip portion of about 15° to 40° with the vertical of said inserts.

2. The percussion drill bit of claim 1 wherein the drill bit operating range for machine torque pressure is between about 8 to 15 bar, and the machine thrust pressure setting for drill bit operation is set between 12 and 20 bar.

3. The percussion drill bit of claim 2 wherein the drill bit operation for optimal percussion drilling provides a machine torque pressure setting at 12 bar, and a machine thrust pressure setting at 15 bar.

4. The percussion drill bit of claim 1 wherein the drill bit is formed of the double chisel design, and the bit body has a gauge diameter between about 1¼" to 2¼".

5. The percussion drill bit of claim 4 wherein the drill bit of double chisel design comprises four inserts provided upon the beveled face, and two inserts fitted within the frontal flat.

6. The percussion drill bit of claim 5 wherein the first and second sets of inserts each comprise at least three inserts.

7. The percussion drill bit of claim 1 wherein said drill bit is formed of the modified double chisel design and said drill bit body has a gauge diameter about 2½" to 3½".

8. The percussion drill bit of claim 7 wherein the drill bit of modified double chisel design comprises between four to six PCD inserts mounted in the beveled face, and from two to four PCD inserts mounted within the frontal flat face.

9. The percussion drill bit of claim 8 wherein the first and second sets of inserts each comprise at least four inserts.

10. The percussion drill bit of claim 9 wherein said inserts having a tip radius between about 0.100 inch to 0.165 inch.

11. The percussion drill bit of claim 1 wherein the polycrystalline diamond coating on each tip of each insert is 0.010-0.030 inch thick.

12. The percussion drill bit of claim 1 wherein the radius from the center axis of the drill bit for each insert provided within the frontal flat face is as set forth in the following chart:

| Drill Bit Size | Number of frontal flat face Inserts | Radius of each insert from the center axis |
|---|---|---|
| 1¼"-1⅝" | 1 | ⅛" |
| 1¾ | 2 | 3/16"-5/16" |
| 2" | 2 | ⅜"-7/16" |
| 2¼ | 2 | ⅜"-7/16" |
| 2½ | 3 | ⅜"-½" |
| 3.0 | 4 | ⅜"-½"-13/16"- |
| 3½ | 4 | 1.0". |

13. The percussion drill bit of claim 1 wherein each insert provided within the drill bit body having dimensions within the ranges as set forth as follows:

| Range Claimed for Inserts | Range Dimensions |
|---|---|
| Overall Length of Insert | .500"-.650" |
| Diameter of Insert | .3000"-.4200" |
| Tip Length | .200"-.260" |
| Tip Angle | 15.00°-35.00° |
| Tip Radius | .100"R-.145"R |
| Grip Length | .290"-.420". |

14. The percussion drill bit of claim 1 wherein each insert provided within the drill bit body having dimensions within the ranges as set forth as follows:

| Range Claimed for Inserts | Range Dimensions |
|---|---|
| Overall Length of Insert | .600"-.785" |
| Diameter of Insert | .3900"-.4900" |
| Tip Length | .250"-.350" |
| Tip Angle | 15.00°-35.00° |

-continued

| Range Claimed for Inserts | Range Dimensions |
|---|---|
| Tip Radius | .120"R-.155"R |
| Grip Length | .300"-.450". |

15. The percussion drill bit of claim 1 wherein each insert provided within the drill bit body having dimensions within the ranges as set forth as follows:

| Range Claimed for Inserts | Range Dimensions |
|---|---|
| Overall Length of Insert | .625"-.785" |
| Diameter of Insert | .4800"-.5200" |
| Tip Length | .260"-.335" |
| Tip Angle | 25.00°-40.00° |
| Tip Radius | .135"R-.170"R |
| Grip Length | .330"-.500". |

* * * * *